United States Patent [19]

Nicholas et al.

[11] Patent Number: 4,708,517

[45] Date of Patent: Nov. 24, 1987

[54] COMPRESSION SEAL

[75] Inventors: John D. Nicholas; Larry M. Petree, both of Lawrenceville; Julian J. Attaway, Marietta, all of Ga.

[73] Assignee: MM Systems Corporation, Tucker, Ga.

[21] Appl. No.: 907,064

[22] Filed: Sep. 15, 1986

[51] Int. Cl.[4] ..... E01C 11/10

[52] U.S. Cl. ..... 404/64; 404/65

[58] Field of Search ..... 404/47, 64, 65, 68, 404/69; 14/16.5; 52/396, 403

[56] References Cited

U.S. PATENT DOCUMENTS

| | | | |
|---|---|---|---|
| 3,358,568 | 12/1967 | Brown . | |
| 3,394,640 | 7/1986 | Dreher . | |
| 3,485,149 | 12/1969 | Boney . | |
| 3,521,528 | 7/1970 | Wangerow . | |
| 3,585,910 | 6/1971 | Brown et al. | 404/69 |
| 3,606,826 | 7/1969 | Bowman . | |
| 3,645,176 | 2/1972 | Berchou . | |
| 3,687,022 | 8/1972 | Brown . | |
| 3,762,826 | 10/1973 | Bowman | 404/64 |
| 3,765,784 | 10/1973 | Watson et al. | 404/64 |
| 3,776,654 | 12/1973 | Brown | 404/65 |
| 3,900,677 | 8/1975 | Barber | 404/64 X |
| 4,043,693 | 8/1977 | Brown | 404/64 |
| 4,098,043 | 7/1978 | McCready | 404/64 |
| 4,148,167 | 4/1979 | Puccio | 404/65 |
| 4,362,428 | 12/1982 | Kerschner | 404/64 |
| 4,457,522 | 7/1984 | Trieste et al. | 404/64 X |
| 4,522,413 | 6/1985 | Nicholas | 404/64 |
| 4,616,460 | 10/1986 | Nicholas | 404/64 |

*Primary Examiner*—James A. Leppink
*Assistant Examiner*—Matthew Smith
*Attorney, Agent, or Firm*—Jones, Askew & Lunsford

[57] ABSTRACT

A device for sealing the joint between adjacent structural members such as concrete slabs in bridges, parking decks, and the like, and for absorbing thermal expansion and contraction of the adjacent structural members. The compression seal employs a cross-sectional configuration comprising a square center cell within a square outer seal structure to provide an advantageous movement rating while minimizing vertical elongation of the seal during compression. As lateral compressive forces are exerted on the vertical sides of the outer square by thermal expansion of the adjacent structural members, the seal collapses in a controlled manner, the square center cell redirecting lateral compressive forces to support the upper and lower seal walls. Thus, the upper wall of the seal provides a substantially planar pedestrian treadway even as the seal is compressed.

5 Claims, 3 Drawing Figures

COMPRESSION SEAL

TECHNICAL FIELD

The present invention relates generally to a sealing device for absorbing thermal expansion and contraction of joints in dynamic structures, and relates more specifically to a compression seal having a square-within-a-square cross-sectional configuration to minimize vertical elongation as the seal is laterally compressed.

BACKGROUND OF THE INVENTION

Compression seals are widely used to seal the void between adjacent structural members, such as concrete slabs in bridges, parking decks, and the like, while absorbing thermal expansion and contraction of the adjacent structures. The seal prevents debris and water from penetrating the joint and causing intrastructure damage, accomplishing this goal by designed collapse of the interior walls of the joint throughout its movement range. Additionally, when the seal is incorporated into a structure designed to accomodate pedestrian traffic, the upper surface of the seal must provide a large supported planar treadway throughout the collapse and expansion of the seal.

Typically, a compression seal is formed from neoprene or the like as an elastomeric extrusion of indeterminate length. The cross-sectional configuration of the seal determines the manner in which the seal collapses as it is subjected to lateral compressive forces. The characteristics which are of primary concern in the design of compression seals are movement ratng and height displacement.

A seal's movement rating is the distance by which a seal can be comprssed from 85% of its nominal width to its width at maximim compression. Under current ASTM standards, when an installed seal is at maximum expansion, that is, when the adjacent structural members are fully thermally contracted, the seal is still compressed to 85% of its nominal width. At maximum expansion, the seal must exert a pressure of at least 3 p.s.i. against the adjacent structural members. This pressure is necessary to maintain the seal in place in the joint between the adjacent structural members, and to prevent moisture and debris from penetrating between the seal and the structural members. In contrast, the seal's maximum closure is defined as the point at which the seal exerts a lateral pressure of 35 p.s.i. against the adjacent structural members. The distance between 85% of the seal's nominal width and its width at maximum closure is the seal's movement rating. It is a desirable characteristic of a compression seal to have a large movement rating, since a narrower seal can be employed to absorb the same amount of thermal expansion and contraction of the adjacent structural members.

However, movement rating is only one characteristic which must be considered. While the seal must collapse in such a controlled manner as to postpone the point of maximum closure, it must also collapse in such a manner as to minimize vertical elongation, or height displacement, of the seal. A compression seal which protrudes above the top surface of the adjacent structrual members as it is compressed can be damaged or dislodged by snowplows or the like and can provide an obstacle upon which pedestrians can trip. When used in structures intended for only vehicular traffic, this problem can be overcome by designing a compression seal which collapses downwardly, rather than protrudes upwardly, as the seal is compressed. However, where the structure is intended to support pedestrian traffic, a downwardly-collapsing seal would present a depression into which women's high heels can become lodged. Accordingly, for pedestrian applications, it is necessary for the compression seal to provide a substantially planar upper surface at all points during the expansion and compression of the seal.

SUMMARY OF THE INVENTION

The present invention provides these and other characteristics desirable in compression seals. Stated generally, the compression seal of the present invention has a cross-sectional configuration which provides a controlled collapse to maximize movement rating while minimizing vertical displacement of the upper seal surface as the seal is subjected to lateral compressive forces. The upper wall of the seal provides a substantially planar upper surface suitable for pedestrian traffic at all points during the expansion and compression of the seal.

Stated somewhat more specifically, the compression seal of the present invention is an elastomeric extrusion of indeterminate length, having a cross-sectional configuration comprising a square within a square. As lateral forces are applied to the side walls of the outer square, these forces are transmitted by diagonal walls to a square center cell. These inward diagonal forces are absorbed by the square center cell and translated into vertical forces which support the upper and lower seal walls from becoming vertically displaced. Thus, the seal absorbs lateral compressive forces without becoming vertically elongated and without collapsing downwardly in such a manner as would be hazardous to pedestrian traffic.

Stated more specifically, the compression seal of the present invention comprises an elastomeric extrusion having a wall construction of substantially square shape in cross-section. A square center cell has two of its opposite corners located in a horizontal plane and its other two opposite corners located in a vertical plane. Diagonal walls extend radially outwardly from the mid-point of each of the walls of the center square. A pair of opposing outer vertical walls define the sides of the compression seal, the diagonal walls connecting to and terminating at the top and bottom of the outer vertical walls. The upper and lower horizontal walls defining the top and bottom of the seal lie substantially in the horizontal planes corresponding to the top and bottom of the outer vertical walls such that the upper and lower horizontal walls and the outer vertical walls define an outer square being the outer perimeter of the seal. Extending radially upwardly and downwardly from the upper and lower corners of the center square are bisecting vertical walls which connect and terminate at the upper and lower horizontal walls of the outer square. Support members depending downwardly and outwardly from the outer edges of the upper horizontal wall and upwardly and outwardly from the outer edges of the lower horizontal wall connect to and terminate at the diagonal walls to form V-shaped stress-relief indentations between the horizontal walls and the outer vertical walls. Finally, substantially diagonal braces extend from the mid-points of each of the outer vertical walls to each of the diagonal walls.

When the compression seal is installed in the joint between mutually facing portions of adjacent structural members, lateral forces are exerted by the adjacent structural members against the outer vertical walls of the compression seal as the structural members expand and contract. These lateral forces are transmitted from the vertical side walls of the seal through the diagonal walls to the center square. The center square simultaneously flattens and elongates, redirecting the compressive forces to the vertical bisecting walls to support the upper and lower horizontal walls as the seal is compressed. Thus, the seal not only absorbs the lateral compressive forces to provide a high movement rating, but redirects those compressive forces in such a manner as to support the upper and lower seal walls, thereby affording a substantially planer upper pedestrian treadway as the seal expands and contracts.

Thus, it is an object of the present invention to provide an improved compression seal.

It is a further object of the present invention to provide a compression seal which efficiently absorbs the lateral compressive forces to provide a maximized movement rating.

It is another object of the present invention to provide a compression seal which does not vertically elongate as the seal is compressed.

It is yet another object of the present invention to provide a compression seal wherein the upper wall of the seal affords a substantially planer pedestrian treadway at all points during the expansion and compression of the seal.

Other objects, features, and advantages of the present invention will become apparent upon rating the following specification when taken in conjection with the drawings and the appended claims.

DETAILED DESCRIPTION OF THE DISCLOSED EMBODIMENT

Figure 1:
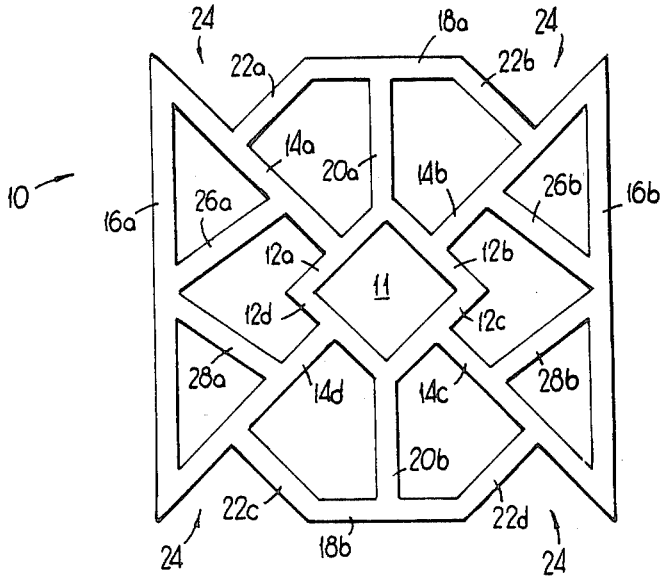
FIG. 1 is an end view of a compression seal according to the present invention.

Referring now in more detail to the drawing, in which like numerals indicate like elements throughout the several views, FIG. 1 shows a compression seal 10 according to the present invention. The seal 10 includes a square center cell 11 comprised of cell walls 12*a*, 12*b*, 12*c*, and 12*d*. One pair of opposing corners of the square center cell 11 lie in a horizontal plane, and the other two opposite corners lie in a vertical plane. Extending radially outwardly from the mid-points of the cell walls 12*a*, 12*b*, 12*c*, and 12*d* are diagonal walls 14*a*, 14*b*, 14*c*, and 14*d*. The diagonal walls 14*a*–14*d* intersect the square center cell walls 12*a*–12*d* substantially perpendicularly.

A pair of opposing outer vertical walls 16*a*, 16*b* define the sides of the seal 10. The diagonal walls 14*a*–14*d* connect to and terminate at the top and bottom of the outer vertical walls 16*a*, 16*b*. Upper and lower horizontal walls 18*a*, 18*b* define the top and bottom of the seal 10 and lie substantially in the horizontal planes corresponding to the top and bottom of the outer vertical walls 16*a*, 16*b*. The upper and lower horizontal walls 18*a*, 18*b* and the outer vertical walls 16*a*, 16*b* define an outer square, being the outer perimeter of the seal 10.

Upper and lower bisecting vertical walls 20*a*, 20*b* extend radially outwardly from the uppermost and lowermost corners of the square center cell 11. The bisecting vertical walls connect to and terminate at the upper and lower horizontal walls 18*a*, 18*b*. Depending downwardly and outwardly from the outer edges of the upper horizontal wall 18*a* are upper walls 22*a*, 22*b*. In a like manner, support walls 22*c*, 22*d* depend upwardly and outwardly from the outer edges of the lower horizontal wall 18*b*. The support members 22*a*–22*d* connect to and terminate at the diagonal walls 14*a*–14*d* to form V-shaped stress-relief indentations 24 between the horizontal walls 18*a*, 18*b* and the outer vertical walls 16*a*, 16*b*.

A substantially diagonal brace 26*a* extends from the mid-point of the outer vertical wall 16*a* to the diagonal wall 14*a*. A lower diagonal brace 28*a*extends to the mid-point of the outer vertical wall 16*a* to the diagonal wall 14*d*. In a similar manner, upper and lower diagonal walls 26*b*, 28*b* extend from the mid-point of the outer vertical wall 16*b* to the diagonal walls 14*b*, 14*c*.

Figure 2:
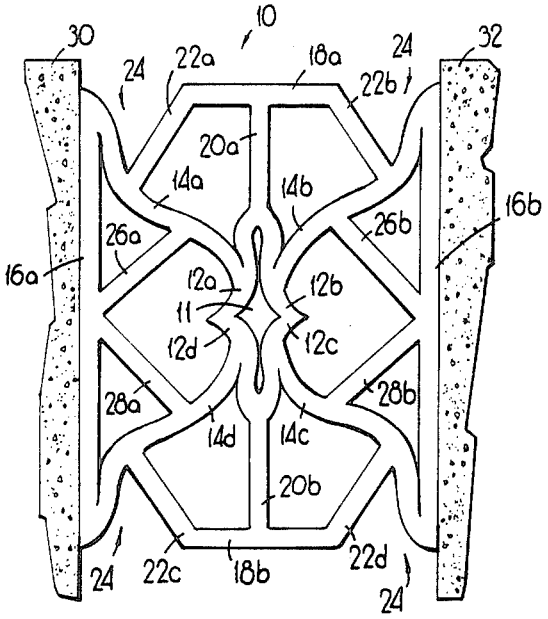
FIG. 2 is an end view of the compression seal of FIG. 1 installed between adjacent structural members and compressed to 85% of its nominal width.

To use the compression seal 10 of the present invention, the seal is installed in the joint between adjacent structural members 30, 32 as shown in FIG. 2. With the structural members 30, 32 in their state of maximum thermal contraction, the compression seal 10 expands to 85% of its nominal width. In this state, the outer vertical walls 16*a*, 16*b* press against the vertical faces of the structural members 30, 32 with a pressure of at least 3 p.s.i. This pressure is sufficient to maintain the seal in place, preventing moisture and debris from penetrating between the seal and the structural members, and supporting any vertical load which might be exerted upon the support wall 18*a* of the seal.

As seen in FIG. 2, the V-shaped stress relief indentations 24 absorb the initial lateral compression as the seal is compressed to 85% of its nominal width. This stress-relief prevents lateral forces which might bow or distort the upper horizontal seal wall 18*a* from being brought directly to bear on the ends of the upper seal wall. The stress-relief indentations 24 are substantially closed even at 85% of nominal width such that the indentations do not present a depression into which a woman pedestrian's high-heels might become lodged. Further, the stress-relief indentations 24 are located at the outer edges of the upper wall 18*a* so that the central portion of the upper seal surface affords an uninterrupted planar pedestrian treadway.

As the seal is compressed, lateral compressive forces exerted against the vertical walls 16*a*, 16*b* are transmitted by the diagonal members 14*a*–14*d* to the walls 12*a*–12*d* of the center square 11. In response to these diagonal forces, the square center cell 11 collapses inwardly, simultaneously flattening and elongating. The collapsing square center cell redirects the diagonal forces through the upper and lower bisecting vertical walls 20*a*, 20*b* to support the upper and lower vertical walls 18*a*, 18*b* as the seal is compressed. The upper diagonal braces 26*a*, 26*b* exert an upward force to prevent the diagonal walls 14*a*, 14*b* from collapsing downwardly as the seal is compressed. This upward force is transmitted through the support members 22*a*, 22*b* to further support the upper wall 18*a*.

Figure 3:
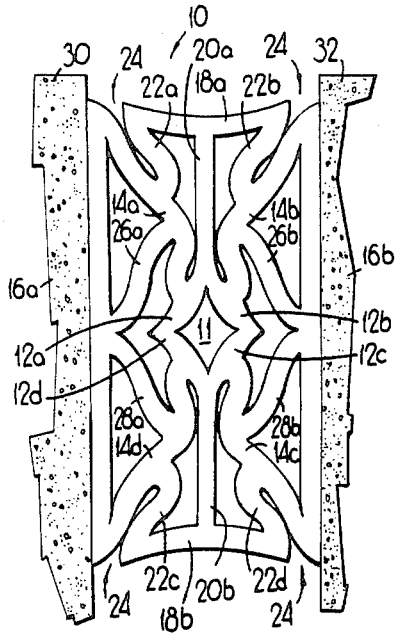
FIG. 3 is an end view of the compression seal of FIG. 1 installed between adjacent structural members and compressed to its maximum closure.

Referring now to FIG. 3, the seal 10 has reached its state of maximum closure. There has been only minimal vertical displacement of the upper and lower bisecting vertical walls 20*a*, 20*b* as the square center cell 11 has collapsed. Accordingly, there has been minimal vertical displacement of the upper and lower horizontal walls 18*a*, 18*b*, even as the seal is compressed to its point of maximum closure. Further, the redirection of the compressive forces by the square center cell 11 through the upper and lower bisecting vertical walls 20*a*, 20*b* maintains the strength of the seal 10 against vertical loads exerted against the upper wall 18*a*, such as by a pedestrian stepping on the upper surface of the seal.

The size of the center square 11 in relation to the outer square in the square-within-a-square cross-sectional configuration affects the dynamic characteristics of the seal 10. As the size of the square center cell 11 is increased, the center cell can absorb more compressive forces before becoming fully compressed. Thus, the movement rating of the compression seal 10 is increased. However, the more the square center cell deforms, the further the upper and lower corners of the center square are displaced, and the greater the vertical elongation of the upper and lower cell walls 18*a*, 18*b*. In contrast, a smaller square center cell 11 will result in a lower movement rating, the square center cell being able to absorb less compression before becoming fully collapsed. However, since the upper and lower corners of the smaller center square cell are not displaced as far before the center cell becomes completely collapsed, the vertical displacement of the upper and lower cell walls 18*a*, 18*b* is minimized. In the preferred embodiment, the center square is approximately 30% the size of the outer square. It has been found that an advantageous balance between maximizing the movement rating of the seal and minimizing the vertical elongation of the seal can be achieved if the center square is from 20% to 50% the size of the outer square. A center square smaller than this range will not provide as satisfactory a movement rating. Similarly, a central square larger than this range will not resist vertical elongation of the seal as effectively as it is compressed.

It will be appreciated by those skilled in the art that the compression seal of the present invention is symmetrical about its horizontal axis. This symmetry affords the advantage that the seal cannot accidentally be installed in the joint upside-down by a careless or unskilled worker.

It will be understood that the terms "upper", "lower", "horizontal", "vertical" and the like are used herein for convenience of description, and are not intended to limit the seal to any particular physical orientation.

Finally, it will be understood that the preferred embodiment of the present invention has been disclosed by way of example, and that other modifications may occur to those skilled in the art without departing from the score and spirit of the dependent claims.

What is claimed is:

1. A device for sealing a void between adjacent dynamic members, said sealing device produced as an elastomeric extrusion having a wall construction of substantially square shape in cross-section comprising:

walls defining a central square having two of its opposite corners located in a horizontal plane and its other two opposite corners located in a vertical plane;

diagonal walls extending radially outwardly substantially from the midpoint of each of said walls defining said central square;

a pair of opposing outer vertical walls defining the sides of said device, said diagonal walls connecting to and terminating at the top and bottom of said outer vertical walls;

upper and lower horizontal walls defining the top and bottom of said device and lying substantially in the horizontal planes corresponding to the top and bottom of said outer vertical walls, said upper and lower horizontal walls and said outer vertical walls defining an outer square being the outer perimeter of said sealing device;

upper and lower bisecting vertical walls extending radially outwardly from the uppermost and lowermost corners of said central square and being connected to and terminating at said upper and lower horizontal walls;

support members depending downwardly and outwardly from the outer edges of said upper horizontal walls and upwardly and outwardly from the outer edges of said lower horizontal walls, said support members connecting to and terminating at said diagonal walls to form V-shaped indentations between said horizontal walls and said outer vertical walls; and substantially diagonal braces extending from the midpoints of each of said outer vertical walls to each of said diagonal walls, whereby, when said device is disposed between mutually facing portions of said adjacent dynamic members, forces exerted by said adjacent dynamic members against said outer vertical walls are transmitted through said diagonal walls to said central square, said central square simultaneously flattening and elongating to redirect said forces to said vertical bisecting walls to support said upper and lower horizontal walls as said device is compressed, thereby providing a substantially planar top surface between said adjacent dynamic surfaces at all points during the compression of said device.

2. The device of claim 1, wherein said support members intersect said diagonal walls at substantially ninety degree angles.

3. The device of claim 1, wherein said diagonal braces intersect said diagonal walls at the midpoint on said diagonal walls between said outer vertical walls and said walls defining said square.

4. The sealing device of claim 1, wherein said central square is from twenty percent to fifty percent the size of said outer square.

5. The sealing device of claim 1, wherein the cross-sectional configuration of said device in the plane transverse to the elongate axis of said device is symmetrical about it horizontal midline, whereby said sealing device cannot accidentally be installed upside-down.

* * * * *